US007140903B2

(12) United States Patent
Pulizzi et al.

(10) Patent No.: US 7,140,903 B2
(45) Date of Patent: Nov. 28, 2006

(54) CONNECTOR RESTRAINT DEVICE

(75) Inventors: Peter S. Pulizzi, Fountain Valley, CA (US); Michael D. Vander Vorste, Sioux Falls, SD (US)

(73) Assignee: Pulizzi Engineering, Inc., Santa Ana, CA (US)

( * ) Notice: Subject to any disclaimer, the term of this patent is extended or adjusted under 35 U.S.C. 154(b) by 0 days.

(21) Appl. No.: 11/213,021

(22) Filed: Aug. 25, 2005

(65) Prior Publication Data

US 2006/0046557 A1 Mar. 2, 2006

Related U.S. Application Data

(60) Provisional application No. 60/604,519, filed on Aug. 26, 2004.

(51) Int. Cl.
*H01R 13/62* (2006.01)

(52) U.S. Cl. ..... 439/371; 439/373

(58) Field of Classification Search ..... 439/371, 439/373

See application file for complete search history.

(56) References Cited

U.S. PATENT DOCUMENTS 4,702,540 A * 10/1987 Siemon ..... 439/371
4,909,757 A * 3/1990 Reed ..... 439/532
5,011,427 A * 4/1991 Martin ..... 439/373
5,044,976 A * 9/1991 Thompson ..... 439/368
5,299,099 A * 3/1994 Archambault ..... 361/837
5,472,355 A * 12/1995 Wittmann ..... 439/373
5,575,665 A * 11/1996 Shramawick et al. ..... 439/49
5,575,677 A * 11/1996 Buckner et al. ..... 439/373
5,731,546 A * 3/1998 Miles et al. ..... 174/135
5,782,648 A * 7/1998 Peterson ..... 439/369
5,954,301 A * 9/1999 Joseph et al. ..... 248/68.1
6,033,251 A * 3/2000 Cook ..... 439/369
6,080,010 A * 6/2000 Daoud ..... 439/541.1
6,095,846 A * 8/2000 Becerra ..... 439/371
6,170,784 B1 * 1/2001 MacDonald et al. ..... 248/65
6,196,859 B1 * 3/2001 Garlarza ..... 439/369
6,375,129 B1 * 4/2002 Koziol ..... 248/68.1
6,396,992 B1 * 5/2002 Debal ..... 385/135
6,485,316 B1 * 11/2002 Chen ..... 439/135
6,491,539 B1 * 12/2002 Johnston ..... 439/373
6,520,792 B1 * 2/2003 Chen-Chiang et al. ..... 439/373
6,568,542 B1 * 5/2003 Chen ..... 211/26
6,589,064 B1 * 7/2003 Chen ..... 439/304
6,679,722 B1 * 1/2004 Pulizzi ..... 439/451
6,683,258 B1 * 1/2004 Tracy et al. ..... 174/135
6,702,237 B1 * 3/2004 Rubenstein et al. ..... 248/68.1
6,739,896 B1 * 5/2004 Sivertsen ..... 439/371
6,767,237 B1 * 7/2004 Shih ..... 439/371
6,802,725 B1 * 10/2004 Rowland et al. ..... 439/144
6,811,415 B1 * 11/2004 Chen ..... 439/133
6,818,834 B1 * 11/2004 Lin ..... 174/135
6,939,161 B1 * 9/2005 Yi et al. ..... 439/373
6,966,792 B1 * 11/2005 Willers et al. ..... 439/373
2002/0068477 A1 * 6/2002 Chen-Chiang et al. ..... 439/373
2004/0038581 A1 * 2/2004 Brown ..... 439/373
2005/0015977 A1 * 1/2005 Decime et al. ..... 29/854

* cited by examiner

*Primary Examiner*—Ross Gushi
(74) *Attorney, Agent, or Firm*—Walter A. Hackler

(57) ABSTRACT

Electrical plug restricting apparatus includes a male inlet connector fixable to an electrical equipment chassis, a restraint device attachable to the connector and including a plug supporting base, the base having apertures therethrough, and at least one plug securing cable tie insertable through the base aperture and having a length sufficient to surround the plug, the tie securing the plug to the base when tightened.

10 Claims, 4 Drawing Sheets

CONNECTOR RESTRAINT DEVICE

The present application claims priority from U.S. Ser. No. 60/604,519 filed Aug. 26, 2004. This application is to be incorporated in its entirety by this specific reference thereto.

FIELD OF INVENTION

The present application relates generally to the field of electrical equipment, more particularly to connector restraint devices and still more particularly to power cord connector restraint devices.

BACKGROUND OF THE INVENTION

Individual pieces of electrical equipment used in large electrical systems, such as computer server systems, are typically rack mounted in bays. Many of these pieces of electrical equipment have a number of electrical connections for intercommunication, and virtually all, if not all, have connections by which power is supplied to the equipment, such connections almost always being at a rear wall of the equipment enclosures (chassis).

As a consequence, a bay of electrical equipment may have a great many exposed electrical cables which must be connected to particular pieces of equipment in particular ways. Technicians servicing the equipment and removing some equipment and installing other equipment are continually handling or working with these cables in relatively narrow isles between bays. Accidental disconnection of some of the cables may thus occur, often causing equipment or system disruption or damage.

To overcome such problems, prior U.S. Pat. No. 6,679,722 to Peter S. Pulizzi, titled "Connector Restraint Device For Electrical Equipment" discloses a device for restraining (i.e., tying down) electrical connector cables to prevent the cable plugs from being unintentionally disconnected from their associated electrical equipment connectors. The disclosed connector restraint device is especially useful for restraining a number of cables connected at a rear chassis wall of an single piece of electrical equipment; however, it would not be economical for retraining only one cable, or possibly even a pair of cables, connected, for example, for supplying power to a single piece of electrical equipment.

It is thus a principal objective of the present invention to provide a single or double cable plug restraining device.

SUMMARY OF THE INVENTION

Electrical plug restraining apparatus in accordance with the present invention generally includes a restraint device fixable to an electrical and equipment chassis over a male inlet connector along with a plug supporting base extending outwardly from the chassis and having apertures therethrough.

At least one plug securing cable tie insertable through the apertures is provided with the cable tie having a length sufficient to surround a plug inserted into the male inlet connector with the cable tie securing the plug to the base when tightened.

More particularly, the apparatus in accordance with the present invention may further include a male inlet connector fixable to an electrical equipment chassis with the restraint device attachable to the connector and including a plug supporting base. The base includes apertures therethrough.

At least one plug securing cable tie insertable through the base apertures has a length sufficient to surround the plug with the tie securing the plug to the base when tightened.

More particularly, the base apertures are spaced apart from one another at a distance of at least a width of the plug. In addition, multiple pairs of apertures may be provided with each pair being spaced apart from one another and spaced apart distances for enabling corresponding cable ties to accommodate a various plug widths. Preferably, the restraint device includes upwardly extending attachment ears fixable to the chassis and the plug supporting base is disposed generally perpendicular to the attachment ears.

A method in accordance with the present invention for securing a plug to an electrical equipment chassis generally includes fixing a male inlet connector to the chassis and thereafter fixing a restraint device having a plug supporting base, to the inlet connector.

The method further includes inserting a plug into the inlet connector with the plug resting in part on the supporting base and thereafter securing the plug to the base with at least one cable tie.

Securing a plug to the base preferably includes passing the cable tie through apertures and multiple cable ties may be passed through spaced apart pairs of apertures in the base.

BRIEF DESCRIPTION OF THE DRAWINGS

The present invention may be more readily understood by consideration of the following detailed description when taken in conjunction with the accompanying drawings, in which.

DETAILED DESCRIPTION

Figure 1:
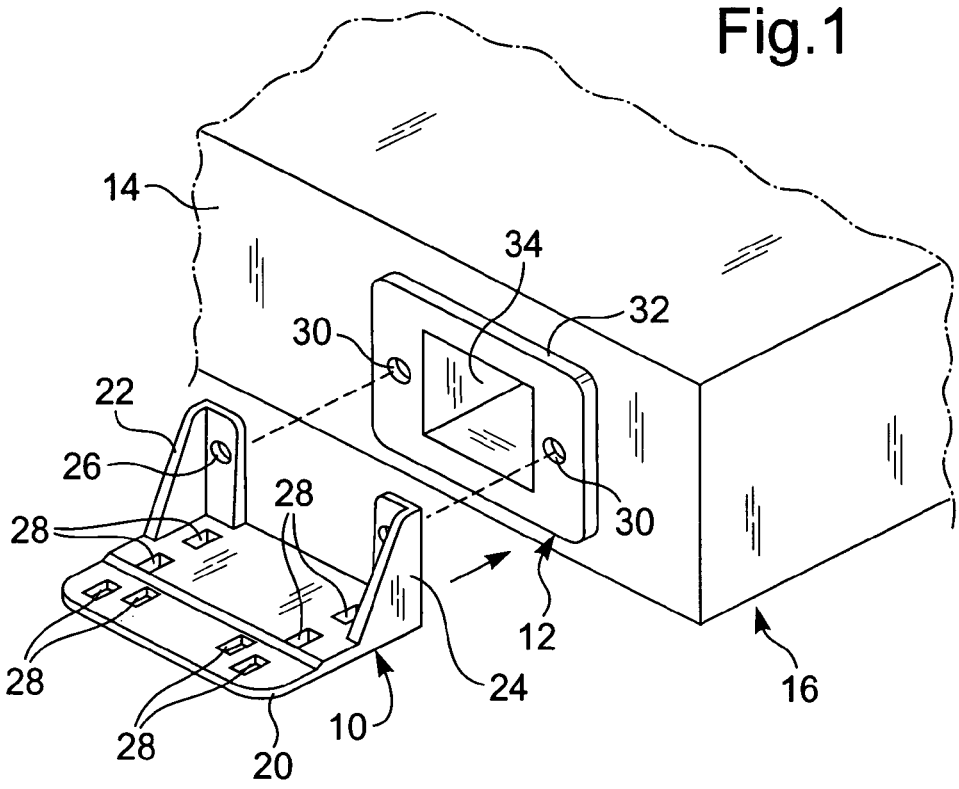
FIG. 1 is a perspective view of electrical plug restraining apparatus in accordance with the present invention generally illustrating a male inlet connector fixable to an equipment chassis along with a restraint device attachable to the connector including a plug supported base and upwardly extending attachment ears.
Figure 2:
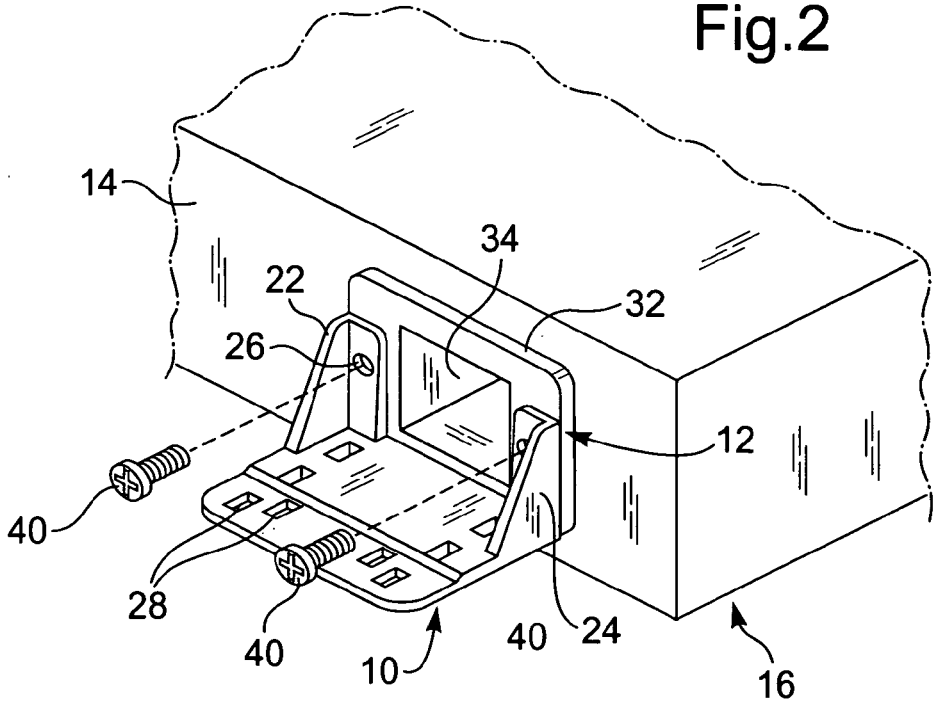
FIG. 2 is a view similar to FIG. 1 illustrating the attachment of the restraint device to the male inlet connector by way of screws.
Figure 3:
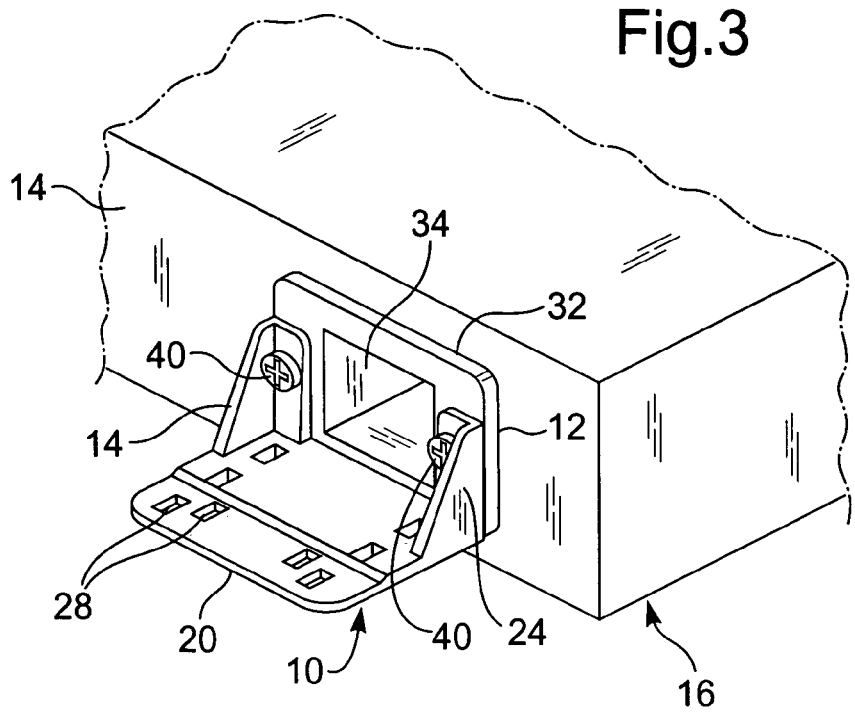
FIG. 3 is similar to FIGS. 1 and 2 showing a complete installation of the restraint device to the chassis.
Figure 4:
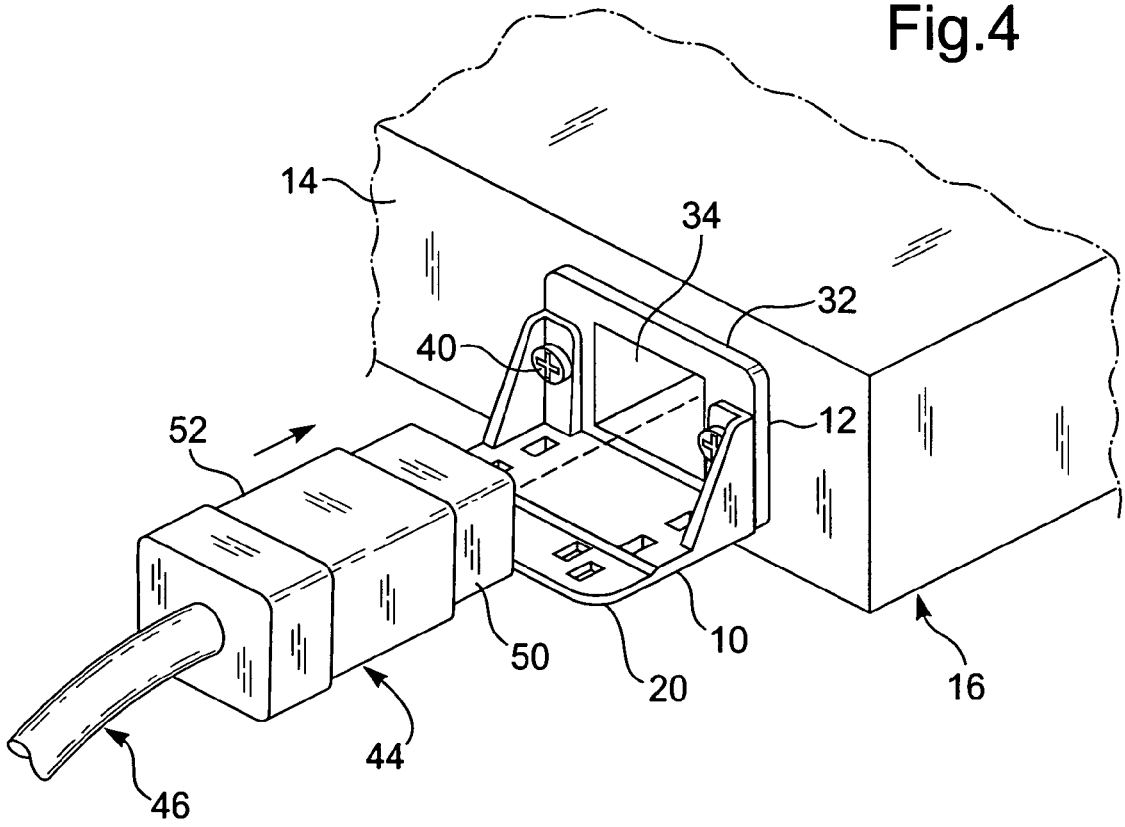
FIG. 4 is a perspective view similar to FIGS. 1–3 and including an insertion procedure of a plug into the male inlet connector.
Figure 5:
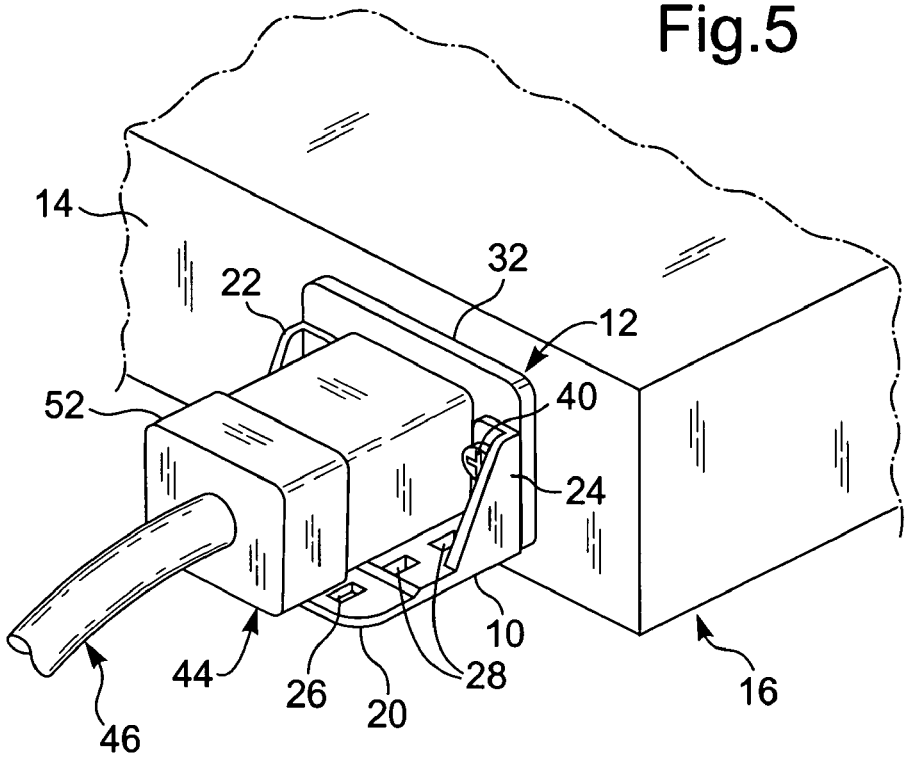
FIG. 5 is a view similar to FIG. 4 illustrating a completed insertion of the plug into the male inlet connector.
Figure 6:
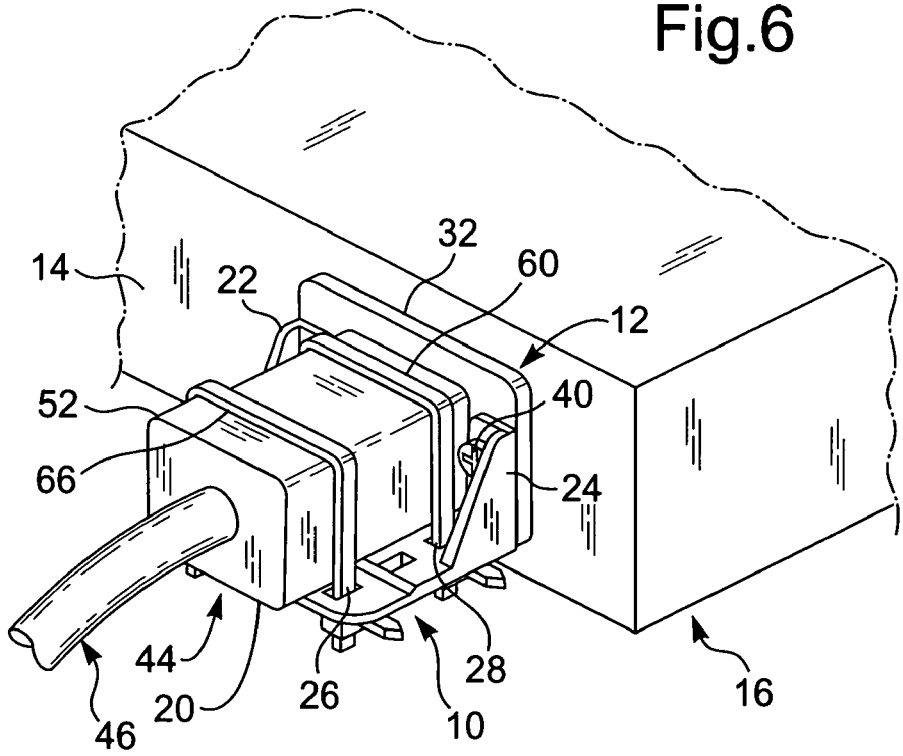
FIG. 6 illustrates the attachment of the plug to the plug supporting base by way of cable ties.
Figure 7B:
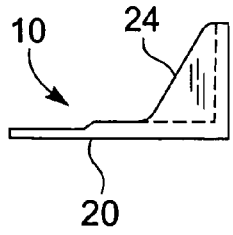
FIG. 7B is a side view of the restraint device illustrated in FIG. 7A.
Figure 7A:
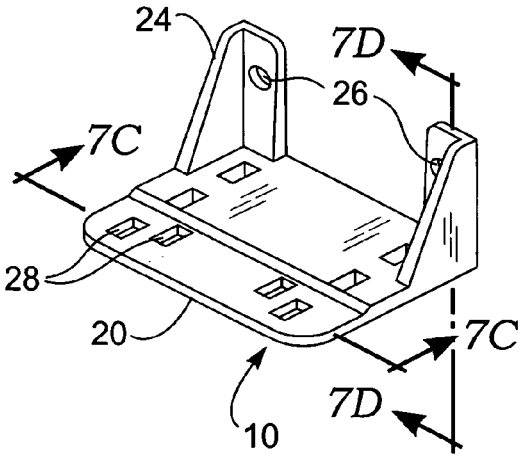
FIG. 7A is a perspective view of the restraint device.
Figure 7C:
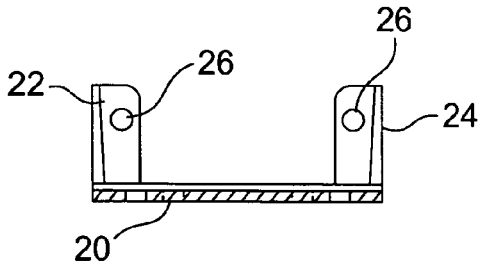
FIG. 7C is a cross sectional view taken along the line 7C—7C of FIG. 7A.
Figure 7D:
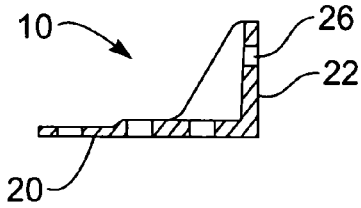
FIG. 7D is a cross sectional view taken along the line 7D—7D in FIG. A.

FIG. 1 is a perspective drawing showing a restraint device 10 according to the present invention in a position for attachment at a male inlet connector 12 installed in a rear wall 14 of an electrical equipment chassis 16 (only portions of which are shown; inlet connector 12 may be an IEC 60320-C20 or -C14; restraint device 10 is shown comprising a flat base portion 20 having two attachment ears 22 and 24 extending upwardly therefrom at a forward region thereof, each of such ears having an attachment aperture 26 formed therethrough (only the aperture in each 22 being shown), and further showing a number of apertures 28 formed through the base portion sized for receiving conventional nylon cable ties (not shown); two chassis attachment apertures 30 being shown in a front region 32 of the inlet connector 12 to either side of a central female plug receiving opening 34;

FIG. 2 is a perspective drawing showing ears 22 and 24 of restraint device 10 positioned against front region 32 of inlet connector 12, with apertures 26 in device ears 22 and 24 aligned with connector apertures 30 (not shown), and showing two screws 40 positioned for installation through device apertures 26 and connector apertures 30 for attaching the restraint device to the inlet connector and for attaching both the restraint device and the inlet connector to chassis 16;

FIG. 3 is a perspective drawing showing screws 40 installed through restraint device ears 22 and 24 and inlet connector 12 to attach the restraint device 10 to the inlet connector 12 and to attach both to chassis 16, restraint device base portion 20 shown projecting outwardly (rearwardly) from chassis rear wall 14 at a right angle;

FIG. 4 is a perspective drawing showing a plug (female) 44 of a connecting power input cable 46 positioned for inserting a connection end 50 of the plug 44 into inlet connector opening 34 and the rearward portion 52 of the plug 44 into restraint device 10 so as to rest on top of device base portion 20;

FIG. 5 is a perspective drawing showing plug 44 fully installed into restraint device 10 with rearward plug portion 52 resting on device base portion 20 and with plug connection end 50 installed through inlet connector opening 34 (not shown) to thereby provide electrical connection at inlet connector 12 of cable 46 to chassis 16 and internal circuitry thereof;

FIG. 6 is a perspective drawing corresponding to FIG. 5, showing cable plug rearward portion 52 tied down to restraint device base portion 20 by two spaced apart cable ties 60 which extend upwardly through base portion apertures 26 to one side of the plug rearward portion, upwardly and over the plug rearward portion and back down through base portion apertures 26 on the other side of the plug rearward portion and are tightly connected in the conventional locking manner to portions of the cable ties that extend under the device base portion, thereby securely locking (restraining) the cable plug to the restraint device to maintain electrical connection of cable 46 at inlet connector 12 to circuitry in chassis 16; plug 44 can be readily released from restraint device 10 by cutting cable ties 60; and FIGS. 7A–7D are engineering drawings of restraint device for use with an IEC 60320-C20-type inlet connector 12 showing various dimensions thereof: FIG. 7A being perspective view of device 10, showing cable tie-down apertures 28 formed in base portion 20; FIG. 7B being a front elevation view of device 10, showing ears 22 and 24 with screw apertures formed therethrough; FIG. 7C being a top view of device 10, showing cable tie-down apertures 28 formed in base portion 20; and FIG. 7D being a side view of device 10, showing ear 24 extending from base portion 20.

In the various figures, the same elements and features are given the same reference numbers and the method of the present invention is sequentially set forth in FIGS. 1–6.

It will be appreciated that although restraint device 10 has been shown and described as being used to restrain female plug 44 of power inlet cord 46 and attached to male inlet connector 12, the restraint device can be readily adapted for restraining a male plug, corresponding to plug 44, of a power outlet cord, corresponding to power inlet cord 46, and be connected to a female outlet connector, corresponding to inlet connector 12.

It will further be appreciated that although FIG. 7 provides dimensions for restraint device 10 configured for use with an IEC 60320-20C inlet connector, the shown dimensions can be readily scaled up or down by one even moderately skilled in the art to provide a corresponding restraint device for use with a different-sized input connector, for example an IEC 60320-C14-type connector or for use with other types of chassis-installed connectors.

It is further within the scope of the present invention, and within the capability of one skilled in the art, to provide a double, triple, or more, side-by-side restraint device by combining two, three, or more of the above-described and shown restraint devices 10 into a single piece device having an appropriate number of ears, such as ears 22 and 24.

Although there has been hereinabove described a specific connector restraint device and method in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. Electrical plug restraining apparatus comprising:

a restraint device fixable to an electrical equipment chassis over a male inlet connection;

a plug supporting base extending outwardly from the chassis and having multiple pairs of apertures therethrough, each pair of operatives being spaced apart from one another at varying distances for enabling corresponding cable ties to accommodate various plug widths, the plug resting on the base adjacent said aperture; and at least one plug securing cable tie insertable through the aperture and having a length sufficient to surround a plug inserted into the male inlet connection, the cable tie securing the plug to the base when tightened.

2. The apparatus according to claim 1 wherein the restraint device includes upwardly extending attachment ears fixable to the chassis.

3. The apparatus according to claim 2 wherein said plug supporting base is disposed generally perpendicular to the attachment ears.

4. Electrical plug restricting apparatus comprising:

a male inlet connector fixable to an electrical equipment chassis;

a restraint device attachable to the connector and including a plug supporting base, the base having multiple pairs of apertures therethrough, each pair of apertures being spaced apart from one another at varying distances for enabling corresponding cable ties to accommodate various plug widths, the plug resting on the base adjacent said apertures; and at least one plug securing cable tie insertable through the base apertures and having a length sufficient to surround the plug, the tie securing the plug to the base when tightened.

5. The apparatus according to claim 4 wherein the restraint device includes upwardly extending attachment ears fixable to the chassis.

6. The apparatus according to claim 5 wherein said plug supporting base is disposed generally perpendicular to the attachment ears.

7. A method for securing a plug to an electrical equipment chassis, the method comprising:

fixing a male inlet connector to the chassis;

fixing a restraint device, having a plug supporting base, to the inlet connector including passing multiple cable ties through spaced apart apertures in the base;

fixing upwardly extending attachment ears to the chassis;

inserting the plug into the inlet connector, the plug resting in part on the supporting base; and securing the plug to the base with at least one cable tie by passing the cable tie through the apertures in the base.

8. Electrical plug restraining apparatus comprising:

a restraint device fixable to an electrical equipment chassis over a male inlet connection;

a plug supporting base extending outwardly from the chassis and having multiple pairs of apertures therethrough, each pair spaced apart from one another at varying distances for enabling corresponding cable ties to accommodate various plug widths; and at least one plug securing cable tie insertable through the aperture and having a length sufficient to surround a plug inserted into the male inlet connection, the cable tie securing the plug to the base when tightened.

9. The apparatus according to claim 8 wherein the restraint device includes upwardly extending attachment ears fixable to the chassis.

10. The apparatus according to claim 8 wherein said plug supporting base is disposed generally perpendicular to the attachment ears.

* * * * *